US009909547B2

(12) United States Patent
Gerbeth et al.

(10) Patent No.: US 9,909,547 B2
(45) Date of Patent: Mar. 6, 2018

(54) QUANTITY-LIMITING VALVE

(71) Applicant: MTU FRIEDRICHSHAFEN GMBH, Friedrichshafen (DE)

(72) Inventors: Robby Gerbeth, Friedrichshafen (DE); Michael Walder, Ravensburg (DE); Andreas Mehr, Kressbronn (DE); Markus Staudt, Ravensburg (DE); Frank Mlicki, Radolfzell (DE)

(73) Assignee: MTU FRIEDRICHSHAFEN GMBH, Friedrichshafen (DE)

( * ) Notice: Subject to any disclaimer, the term of this patent is extended or adjusted under 35 U.S.C. 154(b) by 4 days.

(21) Appl. No.: 14/960,870

(22) Filed: Dec. 7, 2015

(65) Prior Publication Data

US 2016/0084210 A1 Mar. 24, 2016

Related U.S. Application Data

(63) Continuation-in-part of application No. PCT/EP2014/001490, filed on Jun. 3, 2014.

(30) Foreign Application Priority Data

Jun. 12, 2013 (DE) ..... 10 2013 210 983

(51) Int. Cl.

| | |
|---|---|
| ***F02M 61/04*** | (2006.01) |
| ***F02M 63/00*** | (2006.01) |
| ***F02M 63/02*** | (2006.01) |

(52) U.S. Cl.

CPC ..... *F02M 61/042* (2013.01); *F02M 63/0077* (2013.01); *F02M 63/0215* (2013.01); *F02M 2200/28* (2013.01)

(58) Field of Classification Search

CPC ..... F02M 61/042; F02M 63/0077; F02M 63/0215; F02M 2200/28

(Continued)

(56) References Cited

U.S. PATENT DOCUMENTS 4,577,606 A * 3/1986 Bohringer ..... F02M 59/462 123/467
5,295,469 A * 3/1994 Kariya ..... F02M 63/0007 123/456

(Continued)

FOREIGN PATENT DOCUMENTS

| | | | |
|---|---|---|---|
| DE | 44 14 242 | A1 | 10/1995 |
| DE | 10 2007 055 750 | A1 | 7/2008 |
| WO | WO 2004/063558 | A1 | 7/2004 |

*Primary Examiner* — Joseph Dallo
*Assistant Examiner* — Yi-Kai Wang
(74) *Attorney, Agent, or Firm* — Klaus J. Bach

(57) ABSTRACT

In a quantity limiting valve for a fuel injection system of an internal combustion engine including a cylinder with an inflow region and an outflow region separated by a piston axially movably disposed in the cylinder and a flow limiting fluid flow path extending along the piston between the inflow and outflow regions wherein the piston is biased with its front surface into contact with a stop element, the contact area between the front surface and the stop surface includes between the piston and the stop element a contact structure providing for an intermediate space which is in communication with the inflow region thereby to expose the front surface of the piston to the pressure of the fluid in the inflow region.

9 Claims, 2 Drawing Sheets

(58) Field of Classification Search
USPC ..... 123/445
See application file for complete search history.

(56) References Cited

U.S. PATENT DOCUMENTS

| | | | | |
|---|---|---|---|---|
| 5,678,521 | A | 10/1997 | Thompson et al. | |
| 6,082,332 | A * | 7/2000 | Hefler | F02G 5/00 123/446 |
| 6,536,413 | B2 * | 3/2003 | Mori | F02M 63/005 123/467 |
| 2006/0090736 | A1 * | 5/2006 | Nishiwaki | F02M 55/005 123/456 |
| 2006/0096578 | A1 * | 5/2006 | Lehtonen | F02M 55/025 123/456 |
| 2014/0373806 | A1 * | 12/2014 | Hou | F02M 43/04 123/294 |
| 2015/0101688 | A1 * | 4/2015 | Giessauf | F02M 63/0215 137/539 |

* cited by examiner

QUANTITY-LIMITING VALVE

This is a Continuation-In-Part application of pending international patent application PCT/EP2014/001490 filed Jun. 3, 2014 and claiming the priority of German patent application 10 2013 210 983.0 filed Jun. 12, 2013.

BACKGROUND OF THE INVENTION

The invention resides in a quantity-limiting valve for a fuel injection system of an internal combustion engine, the valve including a cylinder with a piston dividing the cylinder interior into an inflow region and an outflow region which, regions are in communication via a communication channel extending along the cylinder which is axially movable for controlling the fuel flow quantity passing through the valve.

Quantity limiting valves of the type with which the present invention is concerned are known. Generally such a quantity limiting valve is arranged in a conductor extending between a high pressure fluid source and an injector in order to limit the fuel quantity supplied to the injector during an opening cycle, and, in this way, the fuel quantity which can be injected into a combustion chamber of the internal combustion engine. In this way, damage to the internal combustion engine by an excessive amount of fuel injected in the combustion chamber for example via a defective injector which may no longer properly close or not close at all, can be prevented.

Such a quantity limiting valve generally includes a housing with an inflow region and an outflow region. It further includes a piston which is movably disposed in a cylinder. The piston divides the cylinder into the inflow region and the outflow region, wherein a fluid communication path is provided via a transfer flow passage extending between a circumferential surface area of the piston and an inner surface area of the cylinder. In a first operating position the piston is biased to abut with its front surface a contact surface of a stop element. The quantity limiting element is arranged in flow direction between the high pressure source and the injector or it is integrated into the injector upstream of the injection structure. As long as the injector is closed, that is a fluid communication to a combustion chamber to which the injector is assigned is blocked, the quantity limiting valve is in its first operating position. When the injector is opened, fuel flows out of the outflow region into the combustion chamber. As a result, the pressure in the outflow region drops and a pressure differential between the inflow region and the outflow region across the piston develops. Because of this pressure differential, the piston is lifted off the stop element and is displaced into the outflow region. At the same time, fuel flows via the transfer passage from the inflow region to the outflow region. The flow cross-section of the transfer passage is so selected that less fuel can flow per time unit via the transfer passage from the inflow region to the outflow region than is supplied to the combustion chamber via the injector from the outflow region. As a result, the pressure difference between the inflow area and the outflow area remains and the piston is moved further toward the outflow region as long as the injector is open. When the injector is closed, fuel continues to flow out of the inflow area via the transfer passage into the outflow region whereby the pressure differential decreases as the piston is moved back into the inflow region until its front area abuts again the stop element where it is again in its first operation position.

However, if the injector remains open because of a defective injector, the piston is moved further into the outflow region and into contact with a sealing surface which it sealingly abuts. Here, the piston is in its second operating position in which the inflow region is fluidically separated from the outflow region or at least from an outflow area of the injector from which fuel is injected into the combustion chamber. Then, fuel can no longer flow from the inlet region to the outlet region. The outlet region is then open to the combustion chamber via the defective injector whereby the pressure differential across the piston is maximized. The piston therefore remains pressed against the sealing surface which blocks any fuel from entering the combustion chamber so that the internal combustion engine is effectively protected from damage by an excessive fuel amount supply to the combustion chamber.

The known quantity limiting valve has the disadvantage that, at the beginning of an injection, the release of the piston out of its first operating position is delayed but then the piston lifts off suddenly from its seat in the first operating position. In particular, if the pressure curve in an individual storage assigned to a particular injector is used for determining the injection begin, the sudden lift off of the piston results in an opening wave superimposed to the pressure curve, that is, to a temporary local excessive pressure which causes an erroneous evaluation of the pressure curve and consequently a faulty determination of the injection begin. It is noted that the opening wave typically changes over the life of the quantity limiting valve. Therefore, faulty evaluation of the pressure signal detected in the individual storage area are unavoidable.

It is therefore the object of the present invention to provide a quantity limiting valve which does not have the disadvantages described above. In particular the quantity limiting valve should avoid the sudden lifting of the piston from its seat in the first operational position so that no excess pressure opening wave occurs, that is, no pressure signal should occur in an individual storage assigned to an injector so that this pressure signal provided in an individual storage area can be evaluated free of errors in a reproducible way and, in particular, an injection begin can be accurately determined.

SUMMARY OF THE INVENTION

In a quantity limiting valve for a fuel injection system of an internal combustion engine including a cylinder with an inflow region and an outflow region separated by a piston axially movably disposed in the cylinder and a flow limiting fluid flow path extending along the piston between the inflow and outflow regions wherein the piston is biased with its front-surface into contact with a stop element, the contact area between the front surface and the stop surface includes between the piston and the stop element a contact structure providing for an intermediate space which is in communication with the inflow region thereby to expose the front surface of the piston to the pressure of the fluid in the inflow region.

In this way, a large part of front surface area of the piston is subjected to the fuel supply pressure so that the piston is more readily lifted off the stop element against which it biased when it is in the first operating position. Preferably, the intermediate space between the front surface of the piston and the stop element of the piston and the inner surface of the cylinder so that, immediately with the opening of the injector a small amount of fuel can already flow from the inflow region into the outflow region. As the piston moves away from the stop element an additional flow path from the inflow region to the outflow section along the piston is opened. In this way, a smoother displacement of the piston out of its first operating position is achieved, that is, the piston is no longer suddenly but rather smoothly moved away from its seat on the stop element. This effectively avoids the formation of an opening pressure wave: a pressure curve in an individual storage of the injector is not disturbed by a reaction behavior of the quantity limiting valve. The pressure curve can therefore be evaluated reproducibly and without errors. The quantity limiting valve response behavior remains unchanged for the life of the quantity limiting valve.

Preferably, the front face of the piston disposed in the quantify limiting valve has at least one projection which extends toward the stop element and forms part of the piston front surface so as to permit pressurized fluid to enter the area between the surface of the stop element and the piston front surface. Instead of a planar front surface, the piston has therefore an axial projection which extends toward the stop element and is provided with a front surface area for contact with the stop element. Preferably, more projections than one are provided each of which has a front surface area to be seated on the stop element. In its first operating position, the piston is then biased with its at least one projection onto the stop element surface so that next to the at least one projection—in particular in a circumferential direction—a space is formed into which fuel can flow from the inflow region when the piston is in its first operating position.

Alternatively, or additionally, the front surface structure may include a cavity which extends into the front surface area, or even more than, one cavity. In this case, at least one intermediate space is formed by the cavity whereby, in the first operating position of the piston, fuel flows from the inflow region info the cavity.

The quantity limiting valve may also have a stop element surface structure with a projection which extends toward the front face of the piston and forms a stop surface. In this case, consequently, the contact structure is not formed exclusively by the piston but also or completely by the stop element. Preferably, more than one projection may be provided on the stop element. Also, in this case, at least one intermediate space is formed around the at least one projection or between the projections.

Alternatively, or additionally a cavity is formed on the stop member surface which cavity extends into the stop element surface. The at least one intermediate space is formed in this case by the at least one cavity.

In a preferred exemplary embodiment, the contact structure comprises at least one projection and/or a cavity in the area of the piston and a projection and/or at least one cavity in the area of the stop element. That is, the described exemplary embodiments may be combined with one another.

In another embodiment, the stop element may be in the form of a stop sleeve which extends to some extent into the cylinder. Preferably, this stop sleeve is provided with a collar which extends along the outer circumference of the sleeve and is disposed on a wall area of the cylinder. The stop sleeve consequently is in the form of a separate part which is advantageous for a simple machining of the stop sleeve. The stop sleeve has a stop surface area which projects into the cylinder so that the contact area of the front surface forming the stop structure is arranged in the interior of the cylinder. In this way, it made sure that the piston is always safely guided in the cylinder.

In a preferred embodiment, the piston is provided with at least one projection extending toward the stop element front surface. Preferably, three such projections are provided. Alternatively or additionally, the piston is provided with at least one cavity, preferably three cavities which extend into the front surface of the piston. With three projections and/or three cavities a particularly position-stable contact between the piston and the stop element is provided for.

With the use of a stop sleeve, the stop sleeve is preferably provided with at least one projection which extends toward the front surface of the piston and which forms the stop element surface. Preferably, three such projections are provided which together form the stop element surface and/or the stop element has at least one cavity, preferably three cavities formed in the stop surface. Also, this configuration provides for a position-stable support in the contact area.

Preferably, the three projections are arranged symmetrically around the longitudinal axis of the quantity limiting valve preferably with an angular spacing of 120°. Correspondingly, the three cavities are arranged preferably symmetrically around the longitudinal axis of the quantity limiting valve with an angular spacing of 120°. Also, in an embodiment wherein the piston and/or the stop element has fewer or more than three projection and/or cavities, they are preferably arranged symmetrically around the longitudinal axis of the quantity-limiting valve and at the same angular spacing.

It is noted that the longitudinal axis of the quantity limiting valve is also considered to be an axis which extends in the direction in which the piston is displaced during operation of the quantity limiting valve. The corresponding longitudinal direction corresponds at the same time to the flow direction of the fuel from the inflow region to the outflow region. A circumferential direction is a direction which extends concentrically around the longitudinal direction. A radial direction is a direction which extends normal to the longitudinal axis.

It is noted that in the quantity limiting valve at least-one of the cavities in the piston front surface or the stop member support surface may be in the form of a radial groove. Such a groove is easy to manufacture and is advantageous with regard to the flow conditions.

In a quantity limiting valve with a stop sleeve, the stop sleeve may be provided with a longitudinal through-bore which, at least to some extent, forms the inflow region. The through-bore is also preferably part of the fuel reservoir or respectively, provides for the conduction of fuel to the injector. It is therefore preferably part of the high pressure line from the high pressure source to the injector.

Finally, in a quantity limiting valve with at least one groove, the at least one groove is in fluid communication at one end with the inflow region and at the opposite end with the flow path formed between the circumferential surface of the piston and the inner surface of the cylinder. In this way, the at least one groove does not only form an intermediate space between the piston and the stop member but, at the same time, a fluid flow path by way of which, upon opening of the injector, fuel can flow instantly out of the inflow region via the groove and the flow path into the outflow region. In this way, the at least one groove provides an essential contribution to the fact that the piston lifts off its seat in the first operating position neither suddenly nor delayed but that rather a smooth continuous opening of the quantity limiting valve is realized without any detrimental effects on the measurement of the pressure in the area of an individual storage assigned to the injector.

Also, an intermediate space between two projections may be viewed as a groove in the sense considered here as the intermediate space extends preferably in a radial direction. In this case, the intermediate space is in fluid communication with the inflow region and also with the transfer flow path so that the same advantages are obtained as explained in connection with the groove.

The quantity limiting valve is preferably used in a fuel injection system of an internal combustion engine with a common high pressure store, that is, a so-called common rail of a common rail fuel injection system. Herein, the individual injectors of the internal combustion engine are in fluid communication with the common high pressure fuel store. The quantity limiting valve is preferably used in connection with an injector which includes an individual store as buffer volume. Preferably, the quantity limiting valve is integrated into the injector and arranged downstream of the individual store, so that, during injection, a fuel supply can flow from the individual store to the inflow region. The quantity limiting valve can be used in connection with all types of fuel which can be injected via an injector into a combustion chamber of an internal combustion engine but also which are injected at a particular point into a common intake pipe or by multipoint injection into the intake ducts of the individual combustion chambers of the internal combustion engine. Fluid fuels in this context comprise liquid as well as gaseous fuels. That is, the quantity limiting valve is for example suitable for the injection of gasoline, diesel fuel, heavy oil, methanol, ethanol or higher alcohols and also methane-containing gases, in particular natural gas, lean gas or special gases as well as any other suitable liquid or gaseous fuel. Also hydrogen or synthesis gases such as a mixture of hydrogen and carbon monoxide can be injected using the quantity limiting valve. However, the use of the quantity limiting valve in connection with fuel which is liquid, under normal conditions is preferred.

An internal combustion in which the quantity limiting valve is used, is preferably a piston engine which may serve for driving land or water vehicles or airplanes. It is also possible to use it in connection with heavy agricultural machinery, mining vehicles or large construction machinery. It may furthermore be used in connection with vehicles used by the military such as tanks for example. It may further be used with internal combustion engines for driving trains that is in locomotives or motor driven rail cars. Also, applications in stationary units in particular for power generation for example in connection with local combined heating and power generating plants for example in the form of emergency power generation units are possible. Such units may be used also for peak power operation but also for continuous power generation. Such engines may further be used as stationary auxiliary or supplemental power generators, for example for driving pumps of fire engines, or on a drilling platform.

The invention will become more readily apparent from the following description of advantageous exemplary embodiments thereof with reference to the accompanying drawings.

DESCRIPTION OF AN EXEMPLARY EMBODIMENT

Figure 1:
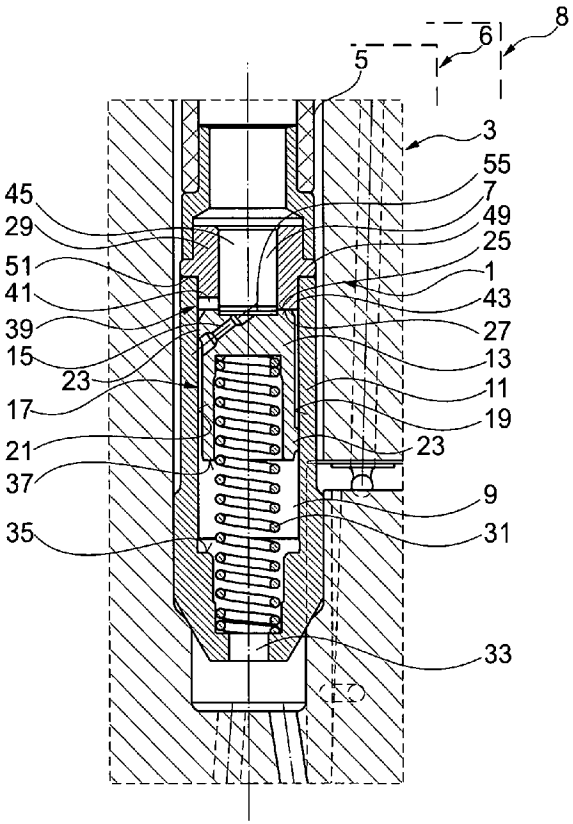
FIG. 1 shows, in a schematic representation, a first exemplary embodiment of the quantity limiting valve in a longitudinal sectional view.

FIG. 1 is a cross-sectional view of an exemplary embodiment of a quantity limiting valve 1. The quantity limiting valve 1 is shown integrated into an injector 3 which includes an individual reservoir 5. The injector 3 is part of a fuel injection system 6 of an internal combustion engine 8 wherein the injection system 6 includes a common high pressure storage. The individual reservoir serves as additional buffer volume.

The quantity limiting valve 1 has an inflow region 7 and an outflow region 9. It includes a cylinder 11 in which a piston 13 is guided so as to be movable in axial direction that is in the longitudinal direction shown vertically in FIG. 1 so as to separate the inflow region 7 from the outflow region 9.

There is however a fluid communication path between the inflow region 7 and the outflow region 9. This path comprises a transfer channel 15 which extends at least partially through the piston 13, diagonally in the shown exemplary embodiment. The transfer channel 15 is at one end in communication with the inflow region 7 and at its other end with a flow path 17 which is formed between a circumferential surface area 19 of the piston 13 and an inner surface area 21 of the cylinder 11.

The piston 13 is provided at its circumferential surface area 19 with projections 23 which extend circumferentially but not fully around the piston 13. The projections may overlap in the circumferential direction or gaps may be provided between the projections 23. In the shown exemplary embodiment, the projections 23 are displaced relative to one another in the longitudinal direction and do not extend longitudinally over the full length of the circumferential surface area 19. Alternatively, the projections 23 may be in the form of longitudinal webs provided on the circumferential surface area 19 to form the flow path 17 between the webs. However, if the projections 23 are axially displaced and overlapping in the circumferential direction, a tortuous flow path 17 is formed through which the fuel flow is conducted around the projections 23.

In FIG. 1, the piston 13 is shown in its first operating position in which it is biased with its front surface 25 onto a stop surface 27 of a stop element 29. In the shown exemplary embodiment, the piston 13 is biased toward the stop element 29 by a spring 31.

The piston 13 remains in its first operating position as long as the injector 3 is closed. When the injector 3 is opened fuel flows out of the outflow region 9 through an outflow area 33 to the injection arrangement of the injector 3 which includes for example an injection control needle. As a result, the pressure in the outflow region 9 drops. As long as the piston 13 is in its first operating position fuel can flow from the inflow region 7 to the outflow region 9 only via the transfer channel 15 and the flow path 17 which, in flow direction—follows the transfer channel 15. As a result of the pressure differential occurring in this way between the inflow region 7 and the outflow region 9, a pressure force is generated at the front surface of the piston 13 which exceeds the force of the spring 31. The piston 13 is then moved in the longitudinal direction toward the outflow region 9 or respectively, into the outflow region, that is in FIG. 1 downwardly. As soon as the piston 13 is lifted off the stop element 29 additional fuel can flow directly into the flow path 17 so that two fluid flow passages are provided between the inflow region 7 and the outflow region 9, that is the restricted fluid flow path via the transfer channel 15 and another path via which the fuel can flow from the inflow region directly into the flow path 17.

The flow cross-sections of these flow paths are so selected that always more fuel can flow out of the outflow region via the outflow area 33 than fuel can flow via the fluid paths out of the inflow region 7. In this way, the pressure differential between the inflow region 7 and the outflow region 9 is maintained and the piston 13 is moved further into the outflow region 9 as long as the injection takes.

When the injector 3 is closed again, a pressure differential first remains as fuel continues to flow out of the inflow region 7 to the outflow region 9 whereby the pressure differential becomes smaller until the piston is returned to its first operating position and the fuel flow from the inflow region to the outflow region stops while the piston 13 is again seated on the stop element 29—preferably before the next injection takes place.

Should the injector 3 become defective so that it remains open the pressure differential across the piston 13 remains so that the piston 13 is moved up to the sealing surface 35 against which it is sealingly pressed via an axial end face area 37. The piston is then in a second operating position wherein no fuel can flow from the inflow region 7 upstream of the piston 13 to the outflow region S downstream of the piston 13 or, respectively, the outflow area 33. As a result, the pressure in the outflow region and the outlet area drops whereby the pressure differential across the piston 7 is maximized and the piston remains firmly pressed into, and retained, in its second operating position. As a result, fuel can no longer flow via the injector 3 into the combustion chamber so that the internal combustion engine is effectively protected from being damaged by an excessive fuel supply.

There is however a problem with such conventional quantity limiting valves in that, upon opening the injector, that is upon injection begin, the piston lifts off delayed and then suddenly from its first operating position. As a result, a so-called opening pressure wave is generated that is a time-wise local excess pressure is generated in an area of the individual reservoir 5 where the fuel pressure signal is detected.

The development of such a pressure wave is prevented by the exemplary embodiment of the quantity limiting valve 1 according to the invention in that the piston front surface and/or the stop element is provided with a surface structure 39 which provides for at least one intermediate space 41 in the interface area between the piston 13 and the stop element 29. The intermediate space 41 is in communication with the inflow region 7. As a result, in the first operating position of the piston 13 fuel from the inflow region is admitted to the intermediate space 41 that is to the contact area between the front face 25 and the stop surface area 27. As a result, a larger surface area of the piston 13 is subjected to the high pressure of the fuel in the inflow area 7 as is the case in conventional quantity limiting valves. Therefore, the piston 13 lifts off without delay that is rapidly from its first-operating position. In addition, via the intermediate space 41 a fluid communication path is opened to the flow path 17 which is normally closed because the projections 23 do not extend along the full circumference of the piston 13. In addition to the transfer channel 15 therefore fuel can then flow also via the intermediate space 41 to the flow path 17 already with the injection begin. That is, an additional fluid flow path is provided whereby the responsiveness of the quantity limiting valve 1 is positively affected and whereby the piston 13 is no longer suddenly but softly moved out of its first operating position.

In the exemplary embodiment of FIG. 1, the contact structure 39 is arranged, solely on the stop element 29 wherein in particular projections 43 are provided which extend, toward the front surface 25 and on which the stop surface 27 is provided. Between the projections 43, of which in FIG. 1 only one is shown, intermediate spaces 41 are formed of which in FIG. 1 also only one is shown. Alternatively cavities or grooves may be provided in the stop surface 27 which act as intermediate spaces 41.

Figure 2A:
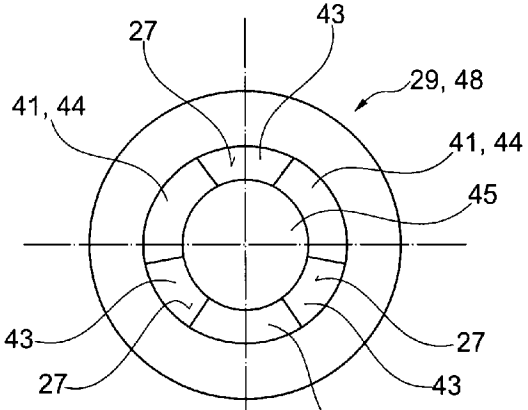
FIG. 2A is a bottom view of a stop element of the first exemplary embodiment.

FIG. 2A is a bottom view of the stop element 29 according to FIG. 1. Identical or functionally identical elements are designated by the same reference numerals so that reference is made to the earlier description. In FIG. 2A, the projections 43 are indicated. The stop element 29 is in this case in the form of a stop sleeve 48 which has three projections 43 which are arranged symmetrically in a circumferential direction and, in particular, with an angular spacing of 120° relative to one another. Between the projections 43—in the circumferential direction—intermediate spaces 41 are provided. In the shown exemplary embodiment, the intermediate spaces may also be called cavities 44 which are provided on the stop surface 27. It is also apparent that the stop surface 27 is provided on the projections 43 and is interrupted by the cavities 44 or respectively, the intermediate spaces 41.

It is also apparent that the stop element 29 has a through-bore 45 extending in the longitudinal direction which is also shown in FIG. 1. The through-bore 45 forms in part also the inflow region 7.

Figure 2B:
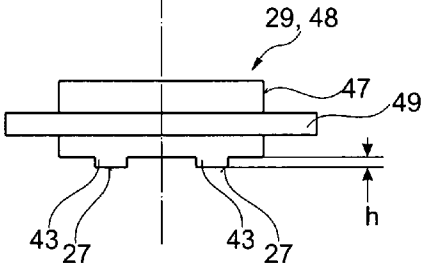
FIG. 2B is a side view of the stop element shown in FIG. 2A and, FIG. 3 shows, in a perspective exploded view, parts of a secondary exemplary embodiment of the quantity limiting valve.

FIG. 2B is a side view of the exemplary embodiment of the stop element 29 shown in FIG. 2A. Again, identical or functionally identical elements are designated by the same reference numeral so that in this respect reference can be made to the preceding description. Here, it is visible that the stop element 29 includes a collar 49 which preferably extends along an outer circumference 47 and which is also shown in FIG. 1. Herewith, it is visible from FIG. 1, that the stop sleeve 48 or respectively the contact element 29 is in contact with a wall 51 of the cylinder 11 via the collar 49.

The effective flow path cross-section of the fluid communication path between the inflow region 7 and the outflow region 9 via the piston 13 is smaller than the flow path cross-section downstream of the outflow region 9. Accordingly, the projections 43 have a smaller height h. The height is preferably between at least a few tenths of a millimeter to at most two millimeters, but preferably only a few tenths of a millimeter.

Figure 3:
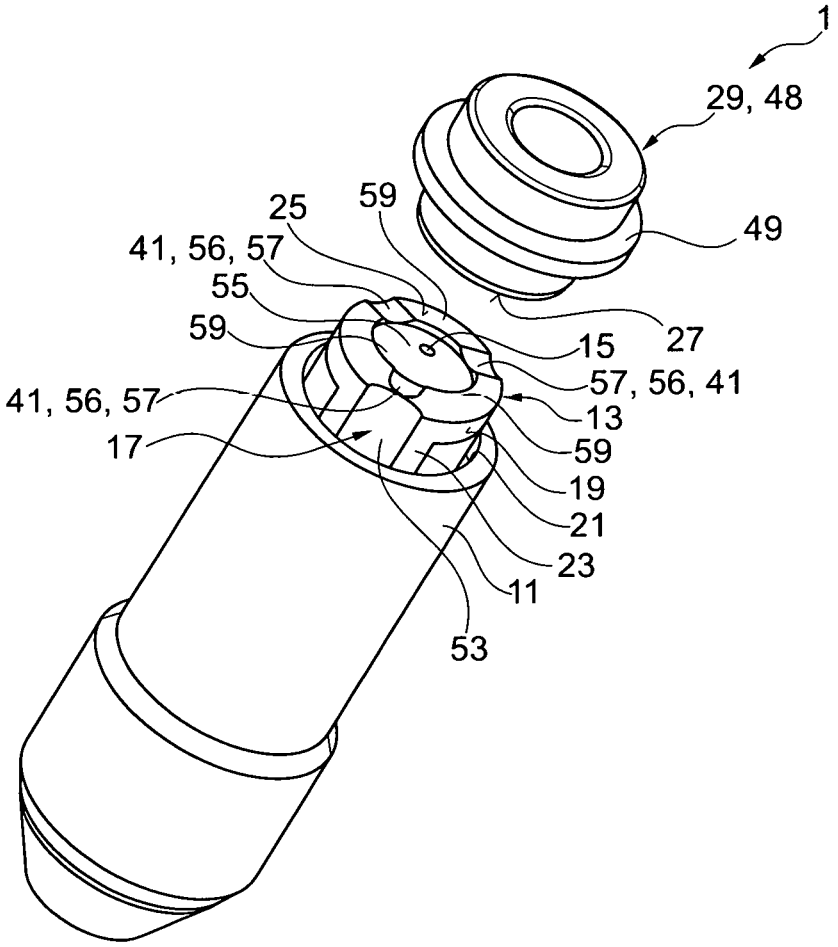

FIG. 3 shows in a three-dimensional perspective view a second exemplary embodiment of a quantity limiting valve 1. Identical or functionally identical elements are indicated again by the same numerals so that reference is made to the previous description. The representation according to FIG. 3 is in the form of an exploded view wherein only selected parts of the quantity limiting valve 1 are shown. In the upper area of FIG. 3, the stop element 29 in the form of a stop sleeve 48 with a collar 49 is shown.

In the lower area of FIG. 3, the cylinder 11 is shown with the piston 13 movably guided therein. It is apparent therefrom that the circumferential surface area 19 of the piston 13 is not everywhere in sealing contact with the inner surface area 21 of the cylinder 11 but that there are rather recessed areas which form the flow path 17. In FIG. 3 such a recessed area 53 faces the viewer. In this area, the circumferential surface of the piston 13 is flattened so that an intermediate recessed area is formed between the piston 13 and the inner surface 21 of the cylinder 11.

For a secure guidance of the piston 13, the piston 13 is provided with the projections of which one disposed next to the recessed area 53 is marked by the numeral 23.

FIG. 3 also shows the transfer channel 15 whose one end opens in a center part 55 of the piston 13 which center part is also shown in FIG. 1 and whose other end opens into a recessed area 53 which is not visible in FIG. 3 as it is arranged at the side remote from the viewer.

In the exemplary embodiment as shown in FIG. 3, the front surface 25 of the piston 13 has three cavities or recesses 56 in the form of radial grooves 57. When the piston 13 is pressed with its front surface 25 onto the stop surface 27, the grooves 57 form intermediate spaces 41 through which fuel may flow as the grooves 57 provide for a flow communication between the inflow region 7 and the flow path 17. This provides for an enlarged front surface area 25 which is subjected to the high pressure fuel in the inflow region 7 for lifting the piston off its first position whereby an additional fluid flow path is generated via which the inflow region 7 is in communication with the outflow region 9. A delayed reaction of the piston 13 as well as a sudden lift off of the piston 13 from the first operating position is therefore effectively prevented. The webs which remain between the grooves 57 which represent the front surface 25 may in the shown exemplary embodiment also be considered to be projections 59 on which the front surface 25 is provided.

As already indicated, it is possible to combine the first exemplary embodiment according to FIGS. 1 and 2 and the second embodiment according to FIG. 3. In particular the projections 59 and/or the cavities 56 may be provided in the areas of the front surface 25 as well as in the area of the stop surface 27.

It is noted that, with the quantity limiting valve 1 according to the invention, the problem caused by a valve opening wave which occurs in particular in connection with an individual reservoir analysis for determining an injection begins can be eliminated. The quantity limiting valve 1 as proposed herein opens smoothly and always in a timely fashion. The measurement of the pressure in the area of the individual reservoir 5 is not negatively affected so that a correct and reproducible determination of the injection begin from the pressure curve measured in the area of the individual reservoir 5 is made possible. The quantity limiting valve 1 is preferably used in connection with injectors 3 designed for the direct injection of the fuel into combustion chambers of internal combustion engines. However, the quantity limiting valve 1 may also be used in connection with a single point injector for injecting fuel into an intake duct serving all of the cylinders of an internal combustion engine or in connection with multipoint injectors for injecting fuel into the individual intake passages leading to the different combustion chambers. The actual use does not change the functions of the quantify limiting valve 1.

What is claimed is:

1. A quantity limiting valve (1) for a fuel injection systems (6) of an internal combustion engine (8), the quantity limiting valve (1) including a cylinder (11) with an inflow region (7) and an outflow region (9) separated by a piston (13) which is movably guided in the cylinder (11), a fluid flow communication path (17) extending along the piston (13) between the inflow region (7) and an outflow region (9), the piston (13) having a front surface (25) and being biased toward a stop element (29) with a stop surface (27) holding the piston (13) in a first operating position thereof in contact with the stop surface (27), the contact area between the front surface (25) and the stop surface (27) being provided with a contact structure (39) which includes at least one intermediate space (41) which is disposed between the piston (13) and the stop element (29) and forming a gap in fluid communication with the inflow region (7) to permit the fluid to enter the intermediate space (41) between the piston (13) and the stop element (29) for rapid actuation of the piston (13).

2. The quantity limiting valve (1) according to claim 1, wherein the contact structure (39) includes at least one projection (43) which extends toward the stop surface (27) and on which at least part of the front surface (25) is formed and also a cavity (44) extending into the front surface (25).

3. The quantity limiting valve (1) according to claim 1, wherein the contact structure (39) has at least one projection extending from the stop element (29) toward the front surface (25) of the piston (13) and which forms at least part of the stop surface and at least one cavity (44, 56) extending into the stop surface (27).

4. The quantity limiting valve (1) according to claim 1, wherein the stop element (29) is in the form of a stop sleeve (48) extending onto the cylinder (11) and being provided with a collar (49) extending around the outer circumference of the stop sleeve (48) and being supported on a wall section (51) of the cylinder (11).

5. The quantity limiting valve (1) according to claim 1, wherein the piston (13) is provided with at least one projection (59) which extends toward the stop element (29) and which is provided with the front surface (25) and forms at least one cavity (56) extending into the front surface (25).

6. The quantity limiting valve (1) according to claim 4, wherein the stop sleeve (48) is provided with at least one projection (43) which extends toward the front surface of the piston (13) and which is provided with the stop surface (27) and with at least one cavity extending into the stop surface (27).

7. The quantity limiting valve (1) according to claim 3, wherein the at least one cavity (44, 56) is in the form of a radially extending groove (57).

8. The quantity limiting valve (1) according to claim 4, wherein the stop sleeve (48) is provided with a through-bore (45) which at least to some extent forms the inflow region (7).

9. The quantity limiting valve (1) according to claim 7, wherein the radially extending groove (57) is in fluid communication with the inflow region (7) and with the flow path (17) formed between circumferential surface area (19) of the piston (13) and the inner surface area (21) of the cylinder (11).

* * * * *